US008736496B2

(12) United States Patent
Nielsen et al.

(10) Patent No.: US 8,736,496 B2
(45) **Date of Patent: *May 27, 2014**

(54) APPARATUS, METHODS AND COMPUTER PROGRAMS FOR WIRELESS COMMUNICATION

(75) Inventors: Bjarne Nielsen, Copenhagen NV (DK); Richard Breiter, Fredriksberg C (DK); Jens Troelsen, Copenhagen NV (DK); Alexandre Pinto, KBH S. (DK)

(73) Assignee: Nokia Corporation, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 13/449,814

(22) Filed: Apr. 18, 2012

(65) Prior Publication Data

US 2012/0200464 A1 Aug. 9, 2012

Related U.S. Application Data

(63) Continuation of application No. 12/157,549, filed on Jun. 10, 2008, which is a continuation-in-part of application No. 12/004,744, filed on Dec. 21, 2007, now Pat. No. 7,876,273.

(51) Int. Cl.
*H01Q 1/24* (2006.01)

(52) U.S. Cl.
USPC ..... 343/702; 343/861

(58) Field of Classification Search
USPC ..... 343/702, 846, 850, 700 MS, 860–862
See application file for complete search history.

(56) References Cited

U.S. PATENT DOCUMENTS

| | | | | |
|---|---|---|---|---|
| 4,835,538 | A | 5/1989 | McKenna et al. | 343/700 MS |
| 6,011,524 | A | 1/2000 | Jervis | 343/895 |
| 6,646,610 | B2 | 11/2003 | Troelsen | 343/702 |
| 6,734,825 | B1 | 5/2004 | Guo et al. | 343/700 |
| 6,937,196 | B2 | 8/2005 | Korva | 343/702 |
| 7,187,959 | B2 | 3/2007 | Ponce De Leon et al. | 455/575.7 |
| 7,242,364 | B2 | 7/2007 | Ranta | 343/860 |
| 7,876,273 | B2 * | 1/2011 | Breiter et al. | 343/702 |
| 2004/0145527 | A1 | 7/2004 | Mikkola | 343/700 MS |

(Continued)

FOREIGN PATENT DOCUMENTS

| | | |
|---|---|---|
| EP | 1 075 043 A1 | 2/2001 |
| EP | 1 439 601 A1 | 7/2004 |

(Continued)

OTHER PUBLICATIONS

"An Internal Dual-Band Mobile Phone Antenna", Suvi Tarvas et al., Apr. 9-14, 2000.

(Continued)

*Primary Examiner* — Michael C Wimer
(74) *Attorney, Agent, or Firm* — Harrington & Smith

(57) ABSTRACT

An apparatus including a cover defining an exterior surface of the apparatus and including a first conductive cover portion; an antenna, connected to a feed point and configured to operate in at least a first resonant frequency band; a first conductive member; a second conductive member; and wherein the first and second conductive members are configured to couple with the first conductive cover portion, the combination of the first and second conductive members and the first conductive cover portion are operable in a second resonant frequency band, different to the first resonant frequency band and are configured to be contactlessly fed by the antenna.

18 Claims, 9 Drawing Sheets

(56) References Cited

U.S. PATENT DOCUMENTS

| | | | | |
|---|---|---|---|---|
| 2004/0147297 | A1 | 7/2004 | Mikkola et al. | 455/575.7 |
| 2005/0113037 | A1 | 5/2005 | Ponce De Leon et al. | 455/90.3 |
| 2006/0135090 | A1 | 6/2006 | Annamaa | 455/95 |
| 2006/0208951 | A1 | 9/2006 | Korva et al. | 343/702 |
| 2007/0120740 | A1 | 5/2007 | Iellici et al. | 343/700 |
| 2008/0088511 | A1 | 4/2008 | Sorvala et al. | 343/700 |
| 2008/0252536 | A1 | 10/2008 | Anguera et al. | 343/702 |

FOREIGN PATENT DOCUMENTS

| | | | |
|---|---|---|---|
| EP | 1 439 604 | A1 | 7/2004 |
| EP | 1544943 | A1 | 6/2005 |
| WO | WO-2004-070875 | A1 | 8/2004 |
| WO | WO-2005/034286 | A1 | 4/2005 |
| WO | WO-2006-070233 | A1 | 7/2006 |
| WO | WO 2007/040431 | A1 | 4/2007 |

OTHER PUBLICATIONS

"Internal Dual-Band Patch Antenna for Mobile Phones", Jani Ollikainen et al., 2000 European Space Agency, reprinted from Proceedings of the AP2000 Millennium Conference on Antennas & Propagation, Davos Switzerland, Apr. 9-14, 2000.

"Resonator-Based Analysis of the Combination of Mobile Handset Antenna Chassis", Perth Vainikainen et al., IEEE Transactions on Antennas and Propagation, vol. 50, No. 10, Oct. 2002.

* cited by examiner

APPARATUS, METHODS AND COMPUTER PROGRAMS FOR WIRELESS COMMUNICATION

CROSS REFERENCE TO RELATED APPLICATION

This is a continuation patent application of U.S. patent application Ser. No. 12/157,549 filed on Jun. 10, 2008, which is a continuation-in-part patent application of U.S. patent application Ser. No. 12/004,744, filed on Dec. 21, 2007, now U.S. Pat. No. 7,876,273.

FIELD OF THE INVENTION

Embodiments of the present invention relate to apparatus, methods and computer programs for wireless communication. In particular, they relate to apparatus, methods and computer programs in a mobile cellular telephone.

BACKGROUND TO THE INVENTION

Apparatus, such as portable communication devices (e.g. mobile cellular telephones) usually include a plastic cover which houses and protects the electronic components of the apparatus from damage (e.g. from atmospheric conditions such as rain or from being knocked by the user of the apparatus). Users usually prefer apparatus with an aesthetically pleasing cover and there is an increasing demand for apparatus which include metallic covers.

Metallic covers are electrically conductive and are sometimes contactlessly (electromagnetically) fed by an antenna element which is positioned within the apparatus to transmit and receive radio frequency signals. However, the operational resonant frequency band of the apparatus is then determined by the dimensions of the cover and this may constrain the design of the cover and the apparatus.

Therefore, it would be desirable to provide an alternative apparatus.

BRIEF DESCRIPTION OF VARIOUS EMBODIMENTS OF THE INVENTION

According to various, but not necessarily all, embodiments of the invention there is provided an apparatus comprising: a cover defining an exterior surface of the apparatus and including a first conductive cover portion; an antenna, connected to a feed point and configured to operate in at least a first resonant frequency band; a first conductive member; a second conductive member; and wherein the first and second conductive members are configured to couple with the first conductive cover portion, the combination of the first and second conductive members and the first conductive cover portion are operable in a second resonant frequency band, different to the first resonant frequency band and are configured to be contactlessly fed by the antenna.

The first conductive cover portion may define an interior surface and/or an exterior surface of the cover. The first conductive member may be positioned between the interior surface of the first conductive cover portion and the antenna.

The apparatus may be for wireless communication.

The first and second conductive members may be configured to electromagnetically couple with the first conductive cover portion.

The second conductive member may be configured to have an electrical length selectable from a plurality of electrical lengths. The second conductive member may be connected to a plurality of matching networks via a switch. The plurality of matching networks may provide at least some of the plurality of electrical lengths. The second conductive member may comprise a plurality of selectable portions. The plurality of selectable portions may provide at least some of the plurality of electrical lengths. The plurality of selectable portions of the second conductive member may be connected to one another via a switch.

The apparatus may further comprise a support member defining an upper surface and a lower surface. The antenna may be physically coupled to the lower surface of the support member and the first conductive member may be physically coupled to the upper surface of the support member. The second conductive member may be physically coupled to the lower surface of the support member, adjacent the antenna.

The second conductive member may include a substantially planar metallic plate.

According to various, but not necessarily all, embodiments of the invention there is provided a portable device comprising an apparatus as described in the preceding paragraphs.

According to various, but not necessarily all, embodiments of the invention there is provided a method comprising: providing a cover defining an exterior surface of an apparatus and including a first conductive cover portion, an antenna, connected to a feed point and configured to operate in at least a first resonant frequency band, a first conductive member, and a second conductive member; configuring the first and second conductive members to couple with the first conductive cover portion, the combination of the first and second conductive members and the first conductive cover portion being operable in a second resonant frequency band, different to the first resonant frequency band; and configuring the combination of the first conductive cover portion and the first and second conductive members to be contactlessly fed by the antenna.

The first conductive cover portion may define an interior surface and/or an exterior surface of the cover. The first conductive member may be positioned between the interior surface of the first conductive cover portion and the antenna.

The method may further comprise configuring the first and second conductive members to electromagnetically couple with the first conductive cover portion.

The method may further comprise configuring the second conductive member to have an electrical length selectable from a plurality of electrical lengths. The method may further comprise connecting the second conductive member to a plurality of matching networks via a switch. The plurality of matching networks may provide at least some of the plurality of electrical lengths. The second conductive member may comprise a plurality of selectable portions. The plurality of selectable portions may provide at least some of the plurality of electrical lengths. The method may further comprise connecting the plurality of selectable portions of the second conductive member to one another via a switch.

The method may further comprise: providing a support member defining an upper surface and a lower surface. The method may comprise physically coupling the antenna to the lower surface of the support member and may comprise physically coupling the first conductive member to the upper surface of the support member. The method may further comprise: physically coupling the second conductive member to the lower surface of the support member, adjacent the antenna.

The second conductive member may include a substantially planar metallic plate.

According to various, but not necessarily all, embodiments of the invention there is provided a computer program that, when run on a controller of an apparatus as described in any of the preceding paragraphs, performs: selecting an electrical length for the second conductive member from a plurality of electrical lengths.

The computer program may further perform: controlling a switch to connect the second conductive member to one of a plurality of matching networks, the plurality of matching networks may provide at least some of the plurality of electrical lengths. The computer program may further perform: controlling a switch to select one of a plurality of selectable portions of the second conductive member, the plurality of selectable portions may provide at least some of the plurality of electrical lengths.

According to various, but not necessarily all, embodiments of the invention there is provided a computer-readable storage medium encoded with instructions that, when executed by a controller of an apparatus as described in any of the preceding paragraphs, perform: selecting an electrical length for the second conductive member from a plurality of electrical lengths.

The instructions may perform: controlling a switch to connect the second conductive member to one of a plurality of matching networks, the plurality of matching networks may provide at least some of the plurality of electrical lengths.

The instructions may perform: controlling a switch to select one of a plurality of selectable portions of the second conductive member, the plurality of selectable portions may provide at least some of the plurality of electrical lengths.

According to various, but not necessarily all, embodiments of the invention there is provided a module comprising: an antenna, connected to a feed point and configured to operate in at least a first resonant frequency band; a first conductive member; a second conductive member; and wherein the first and second conductive members are configurable to couple with a first conductive cover portion of a cover defining an exterior surface of an apparatus, the combination of the first and second conductive members and the first conductive cover portion are operable in a second resonant frequency band, different to the first resonant frequency band and are configured to be contactlessly fed by the antenna.

According to various, but not necessarily all, embodiments of the invention there is provided a method comprising: providing a module comprising an antenna, connected to a feed point and configured to operate in at least a first resonant frequency band, a first conductive member, and a second conductive member; the first and second conductive members for coupling with a first conductive cover portion of a cover defining an exterior surface of an apparatus, the combination of the first and second conductive members and the first conductive cover portion being operable in a second resonant frequency band, different to the first resonant frequency band; the combination of the first conductive cover portion and the first and second conductive members being configurable to be contactlessly fed by the antenna.

According to various, but not necessarily all, embodiments of the invention there is provided a module comprising: a cover defining an exterior surface of the module and including a first conductive cover portion; an antenna, connected to a feed point and configured to operate in at least a first resonant frequency band; a first conductive member; a second conductive member; and wherein the first and second conductive members are configured to couple with the first conductive cover portion, the combination of the first and second conductive members and the first conductive cover portion are operable in a second resonant frequency band, different to the first resonant frequency band and are configured to be contactlessly fed by the antenna.

According to various, but not necessarily all, embodiments of the invention there is provided a method comprising: providing a cover defining an exterior surface of a module and including a first conductive cover portion, an antenna, connected to a feed point and configured to operate in at least a first resonant frequency band, a first conductive member, and a second conductive member; configuring the first and second conductive members to couple with the first conductive cover portion, the combination of the first and second conductive members and the first conductive cover portion being operable in a second resonant frequency band, different to the first resonant frequency band; and configuring the combination of the first conductive cover portion and the first and second conductive members to be contactlessly fed by the antenna.

According to various, but not necessarily all, embodiments of the invention there is provided an apparatus comprising: a cover defining an exterior surface of the apparatus and including a first conductive cover portion; an antenna, connected to a feed point and configured to operate in at least a first resonant frequency band; a conductive member configured to couple with the first conductive cover portion and configured to have an electrical length selectable from a plurality of electrical lengths; and wherein the combination of the conductive member and the first conductive cover portion being operable in a plurality of resonant frequency bands, different to the first resonant frequency band and are configured to be contactlessly fed by the antenna.

The first conductive cover portion may define an interior surface and/or an exterior surface of the cover. The conductive member may be positioned between the interior surface of the first conductive cover portion and the antenna.

The apparatus may be for wireless communication.

According to various, but not necessarily all, embodiments of the invention there is provided a method comprising: providing: a cover defining an exterior surface of an apparatus and including a first conductive cover portion; an antenna, connected to a feed point and configured to operate in at least a first resonant frequency band; a conductive member; configuring the conductive member to couple with the first conductive cover portion and configuring the conductive member to have an electrical length selectable from a plurality of electrical lengths; and wherein the combination of the conductive member and the first conductive cover portion being operable in a plurality of resonant frequency bands, different to the first resonant frequency band and are configured to be contactlessly fed by the antenna.

The first conductive cover portion may define an interior surface and/or an exterior surface of the cover. The conductive member may be positioned between the interior surface of the first conductive cover portion and the antenna.

According to various, but not necessarily all, embodiments of the invention there is provided a computer program that, when run on a controller of an apparatus as described in any of the preceding paragraphs, performs: selecting an electrical length for the conductive member from the plurality of electrical lengths.

According to various, but not necessarily all, embodiments of the invention there is provided a computer-readable storage medium encoded with instructions that, when executed by a controller of an apparatus as described in any of the preceding paragraphs, perform: selecting an electrical length for the conductive member from the plurality of electrical lengths.

According to various, but not necessarily all, embodiments of the invention there is provided a module comprising: an antenna, connected to a feed point and configured to operate in at least a first resonant frequency band; a conductive member configured to couple with a first conductive cover portion of a cover defining an exterior surface of an apparatus; and configured to have an electrical length selectable from a plurality of electrical lengths; and wherein the combination of the conductive member and the first conductive cover portion being operable in a plurality of resonant frequency bands, different to the first resonant frequency band and are configurable to be contactlessly fed by the antenna.

According to various, but not necessarily all, embodiments of the invention there is provided a method comprising: providing: a module comprising an antenna, connected to a feed point and configured to operate in at least a first resonant frequency band, a conductive member; the conductive member being configurable to couple with a first conductive cover portion of a cover defining an exterior surface of an apparatus; the conductive member being configurable to have an electrical length selectable from a plurality of electrical lengths; and wherein the combination of the conductive member and the first conductive cover portion being operable in a plurality of resonant frequency bands, different to the first resonant frequency band and are configurable to be contactlessly fed by the antenna.

According to various, but not necessarily all, embodiments of the invention there is provided a module comprising: a cover defining an exterior surface of the module and including a first conductive cover portion; an antenna, connected to a feed point and configured to operate in at least a first resonant frequency band; a conductive member configured to couple with the first conductive cover portion and configured to have an electrical length selectable from a plurality of electrical lengths; and wherein the combination of the conductive member and the first conductive cover portion being operable in a plurality of resonant frequency bands, different to the first resonant frequency band and are configured to be contactlessly fed by the antenna.

According to various, but not necessarily all, embodiments of the invention there is provided a method comprising: providing: a cover defining an exterior surface of a module and including a first conductive cover portion; an antenna, connected to a feed point and configured to operate in at least a first resonant frequency band; a conductive member; configuring the conductive member to couple with the first conductive cover portion and configuring the conductive member to have an electrical length selectable from a plurality of electrical lengths; and wherein the combination of the conductive member and the first conductive cover portion being operable in a plurality of resonant frequency bands, different to the first resonant frequency band and are configured to be contactlessly fed by the antenna.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 2:
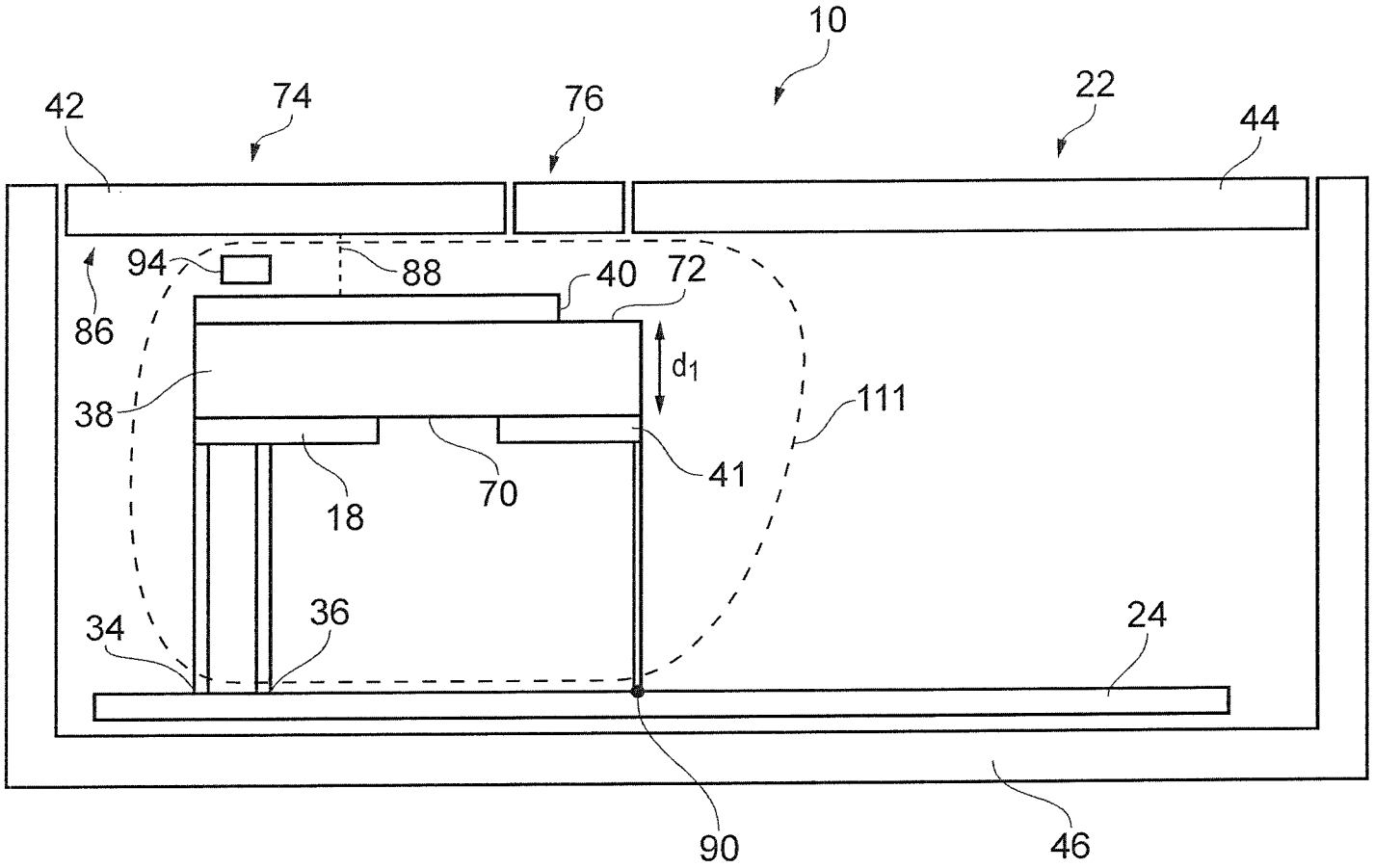
FIG. 2 illustrates a schematic cross sectional side view of an apparatus according to various embodiments of the present invention.

FIG. 2 illustrates an apparatus 10 comprising: a cover 22 defining an exterior surface 74 of the apparatus 10 and including a first conductive cover portion 42; an antenna 18, connected to a feed point 34 and configured to operate in at least a first resonant frequency band; a first conductive member 40; a second conductive member 41; and wherein the first and second conductive members 40, 41 are configured to couple with the first conductive cover portion 42, the combination of the first and second conductive members 40, 41 and the first conductive cover portion 42 are operable in a second resonant frequency band, different to the first resonant frequency band and are configured to be contactlessly fed by the antenna 18.

Figure 1:
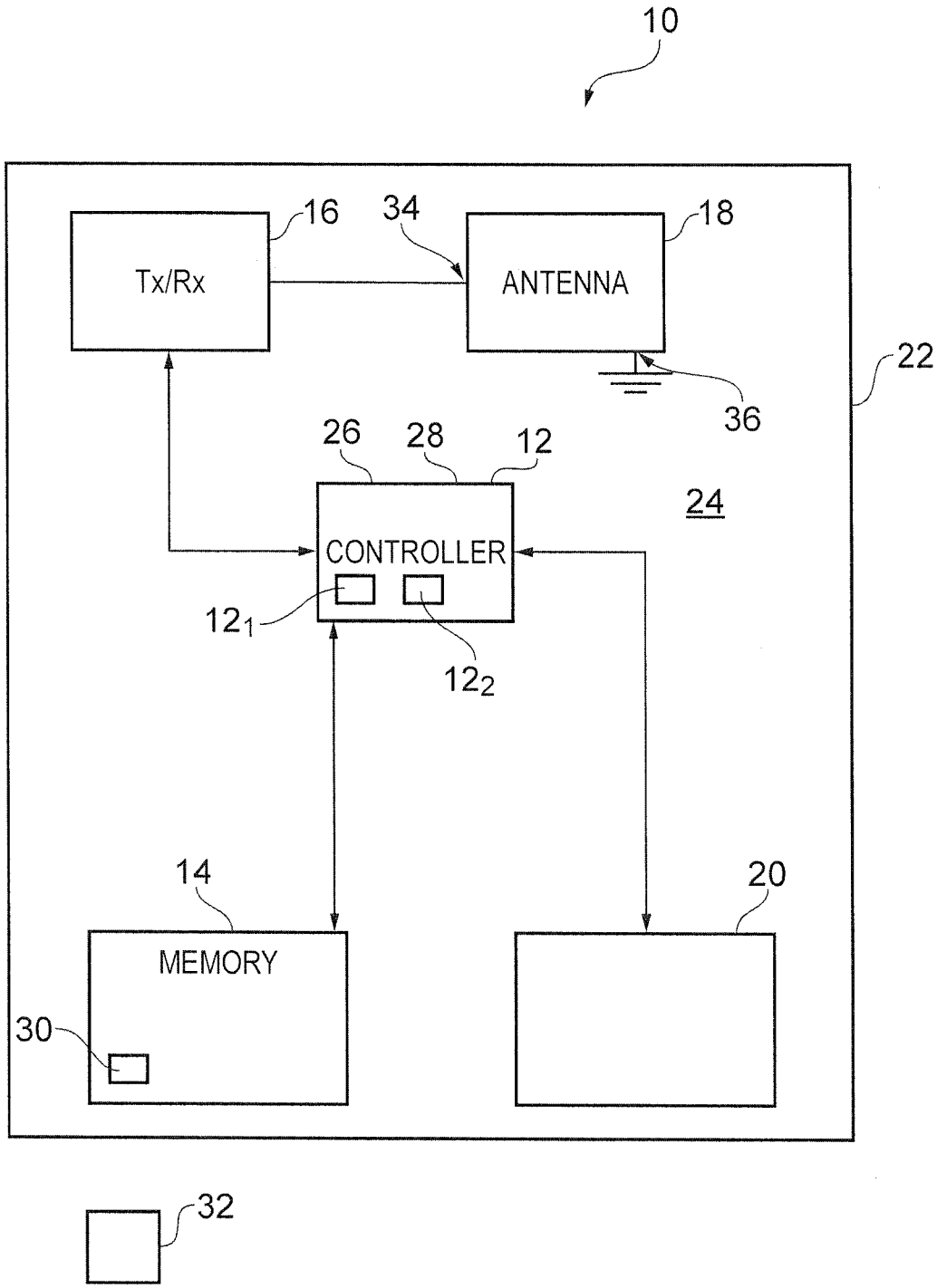
FIG. 1 illustrates a schematic diagram of an apparatus according to various embodiments of the invention.

FIG. 1 illustrates a schematic diagram of an apparatus 10 according to various embodiments of the present invention. The apparatus 10 includes a controller 12, memory 14, a transceiver 16, an antenna 18, optional other circuitry 20 and a cover 22.

In the following description, the wording 'connect' and 'couple' and their derivatives mean operationally connected/coupled. It should be appreciated that any number or combination of intervening components can exist (including no intervening elements). Additionally, it should be appreciated that the connection/coupling may be a physical galvanic connection and/or an electromagnetic connection.

The apparatus 10 may be any portable device and may be, for example, a mobile cellular telephone, a personal digital assistant (PDA), a laptop computer, a palm top computer, a portable WLAN or WiFi device, or module for such devices. As used here, 'module' refers to a unit or apparatus that excludes certain parts/components that would be added by an end manufacturer or a user.

In the embodiment where the apparatus 10 is a mobile cellular telephone, the other circuitry 20 includes input/output devices such as a microphone, a loudspeaker, keypad and a display. The electronic components that provide the controller 12, the memory 14, the transceiver 16, the antenna 18 and the other circuitry 20 are interconnected via a printed wiring board (PWB) 24 which may serve as a ground plane for the antenna 18. In various embodiments, the printed wiring board 24 may be a flexible printed wiring board.

The implementation of the controller 12 can be in hardware alone (e.g. a circuit, a processor etc), have certain aspects in software including firmware alone or can be a combination of hardware and software (including firmware). The controller 12 may be any suitable controller and may include a microprocessor $\mathbf{12}_1$ and memory $\mathbf{12}_2$. The controller 12 may be implemented using instructions that enable hardware functionality, for example, by using executable computer program instructions in a general-purpose or special-purpose processor that may be stored on a computer readable storage medium (e.g. disk, memory etc) to be executed by such a processor.

The controller 12 is configured to read from and write to the memory 14. The controller 12 may also comprise an output interface 26 via which data and/or commands are output by the controller 12 and an input interface 28 via which data and/or commands are input to the controller 12.

The memory 14 may be any suitable memory and may, for example be permanent built-in memory such as flash memory or it may be a removable memory such as a hard disk, secure digital (SD) card or a micro-drive. The memory 14 stores a computer program 30 comprising computer program instructions that control the operation of the apparatus 10 when loaded into the controller 12. The computer program instructions 30 provide the logic and routines that enables the apparatus to perform the method illustrated in FIG. 11. The controller 12 by reading the memory 14 is able to load and execute the computer program 30.

The computer program may arrive at the apparatus 10 via any suitable delivery mechanism 32. The delivery mechanism 32 may be, for example, a computer-readable storage medium, a computer program product, a memory device, a record medium such as a CD-ROM or DVD, an article of manufacture that tangibly embodies the computer program 30. The delivery mechanism may be a signal configured to reliably transfer the computer program 30. The apparatus 10 may propagate or transmit the computer program 30 as a computer data signal.

Although the memory 14 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (e.g. Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

The antenna 18 is connected to the transceiver 16, which is in turn connected to the controller 12. The controller 12 is configured to provide signals to the transceiver 16. The transceiver 16 is configured to receive and encode the signals from the controller 12 and provide them to the antenna 18 for transmission. The transceiver 16 is also operable to receive and decode signals from the antenna 18 and then provide them to the controller 12 for processing.

The antenna 18 may be any antenna which is suitable for operation in an apparatus such as a mobile cellular telephone. For example, the antenna 18 may be a planar inverted F antenna (PIFA), a planar inverted L antenna (PILA), a loop antenna, a monopole antenna or a dipole antenna. The antenna 18 may be a single antenna with one feed, a single antenna with multiple feeds or it may be an antenna arrangement which includes a plurality of antennas (e.g. such as any combination of those mentioned above) with a plurality of feeds. The antenna 18 is electrically connected to the transceiver 16 at a feed point 34 and may be connected to the ground plane 24 at a ground point 36. The antenna 18 may also have matching components between one or more feeds and the radio circuitry (or transceiver), these components may be lumped components (e.g. inductors and capacitors) or transmission lines, or a combination of both. The antenna 18 is operable in at least one operational resonant frequency band and may also be operable in a plurality of different radio frequency bands and/or protocols (e.g. GSM, CDMA, and WCDMA). In various embodiments, the antenna 18 is operable in a first resonant frequency band and a third resonant frequency band, different to the first resonant frequency band. It should be appreciated that the antenna 18 may, in other embodiments, be operable in more operational resonant frequency bands and/or radio frequency protocols.

With reference to FIG. 2, the apparatus 10 also includes a support member 38, a first conductive member 40 and a second conductive member 41. Additionally, the cover 22 includes a first conductive cover portion 42, a second conductive cover portion 44 and a third cover portion 46. The antenna 18 is physically coupled to a lower surface 70 of the support member 38. The physical coupling may be any suitable type of coupling and may be one of the following plating techniques; laser direct structuring (LDS), two shot molded interconnect devices (MID), physical vapor deposition (PVD) or conductive ink. These techniques are well known in the art of plating and will consequently not be discussed in detail here. The first conductive member 40 may also be a sheet of metal (or any other type of conductive sheet) which may be heat staked or adhered to the support member 38. The support element 38 comprises dielectric material and has a depth d1.

Figure 3:
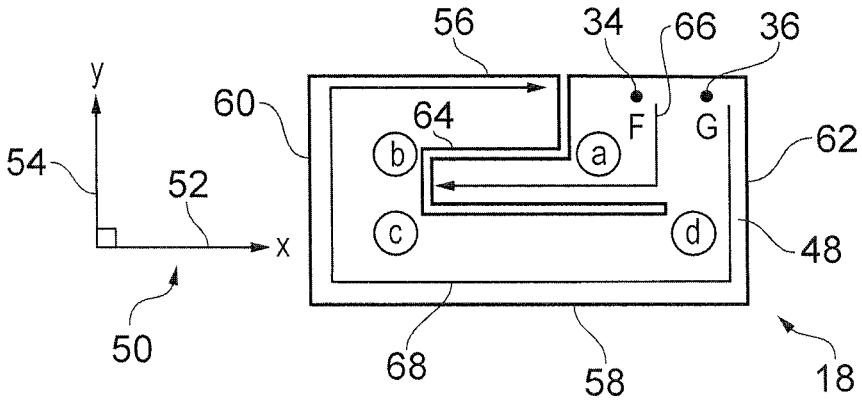
FIG. 3 illustrates a schematic plan view of an antenna according to various embodiments of the present invention.

FIG. 3 illustrates a schematic plan view of one embodiment of an antenna 18. It should be appreciated that the embodiment illustrated in FIG. 3 is an example and is provided to illustrate how an antenna may be operable in more than one resonant frequency band.

In this embodiment the antenna 18 is a planar inverted F antenna which includes a substantially planar antenna track 48, a feed point 34 and a ground point 36. In other embodiments, the antenna track 48 may have a curved and shaped profile which corresponds to the curvature and shape of the apparatus cover 22. FIG. 3 also illustrates a Cartesian coordinate system 50 which includes an X axis 52 and a Y axis 54 which are orthogonal to one another.

The antenna track 48 is substantially rectangular and has a top edge 56, a bottom edge 58, a left edge 60 and a right edge 62. The distance between the left edge 60 and the right edge 62 is greater than the distance between the top edge 56 and the bottom edge 58. The antenna track 48 defines a slot 64 which extends from the middle of the top edge 56 of the antenna track 48 in the −Y direction until a point (a). The slot 64 then makes a right angled right handed turn and extends in the −X direction until a point (b). The slot 64 then makes a right angled left handed turn and extends in the −Y direction until point (c). The slot 64 then makes a right angled left handed turn and extends in the +X direction until it's end point (d).

When the antenna 18 is electrically fed by the transceiver 16, a first current path 66 extends from the feed point 34 to the slot 64 between points (b) and (c). The first current path 66 causes the antenna 18 to be operable in a first resonant frequency band. Additionally, when the antenna 18 is electrically fed by the transceiver 16, a second current path 68 extends from the feed point 34, around the slot 64 (i.e. past points (d), (c) and (b)) to between where the slot 64 extends from the top edge 56 of the antenna track 48 and point (a). The second current path 68 causes the antenna 18 to be operable in a third resonant frequency band, different to the first resonant frequency band.

Returning to FIG. 2, the first conductive member 40 is physically coupled to an upper surface 72 of the support member 38 and may be coupled via any of the plating techniques mentioned in the previous paragraph. The selection of the dimensions of the first conductive member 40 will be discussed in the following paragraphs. In various embodiments of the present invention, the first conductive member 40 is a substantially planar metallic plate.

In this embodiment, the second conductive member 41 is physically coupled to the lower surface 70 of the support member 38 and may be coupled via any of the plating techniques mentioned in the previous paragraph. The positioning and the selection of the dimensions of the second conductive member 41 will be discussed in the following paragraphs. However, it should be appreciated that the second conductive member 41 does not have to be physically coupled to the lower surface 70 of the support member 38. For example, the second conductive member 41 may be physically coupled to a side surface of the support member 38 or may not be physically coupled to the support member 38 at all. In various embodiments of the present invention, the second conductive member 41 is a substantially planar metallic plate.

Embodiments of the present invention may provide an advantage in that the distance between the antenna 18 and the first conductive member 40 and the second conductive member 41 can be relatively easily controlled by selecting the depth d1 of the support member 38. Since the positioning of the first and second conductive members 40, 41 affects the tuning of the antenna 18 (the antenna 18 electromagnetically couples to the first and second conductive members 40, 41), embodiments of the present invention may facilitate the tuning of the antenna 18. For example, if the depth d1 is decreased, the antenna 18 electromagnetically couples more strongly with the first and second conductive members 40, 41 which results in the electrical length of the antenna 18 increasing and the resonant frequencies of the antenna element 18 decreasing.

The cover 22 houses the electronic components of the apparatus 10 (e.g. the controller 12, the memory 14 etc) and helps to protect them from damage (e.g. atmospheric conditions such as rain, accidental impacts from the user etc). The cover 22 defines the exterior surface 74 of the apparatus 10 which is visible to the user and may include a plurality of separable portions.

In this embodiment, the first, second and third cover portions 42, 44, 46 define an aperture 76 which may comprise an insulative material. In other embodiments, the cover 22 may be a single element and comprise the first conductive cover portion 42 which defines the aperture 76.

It should be appreciated that the above mentioned aperture 76 is not the same as an 'antenna aperture' as known in the art of antennas. The above mentioned aperture 76 is a gap between the first conductive cover portion 42, the second conductive cover portion 44 and the third cover portion 46 which may be filled with a suitable insulative material. In various embodiments of the present invention, the aperture 76 may be slot shaped.

The first conductive cover portion 42 and or second conductive cover portion 44 may comprise stainless steel, or other aesthetically pleasing hard wearing metals.

Figure 4A:
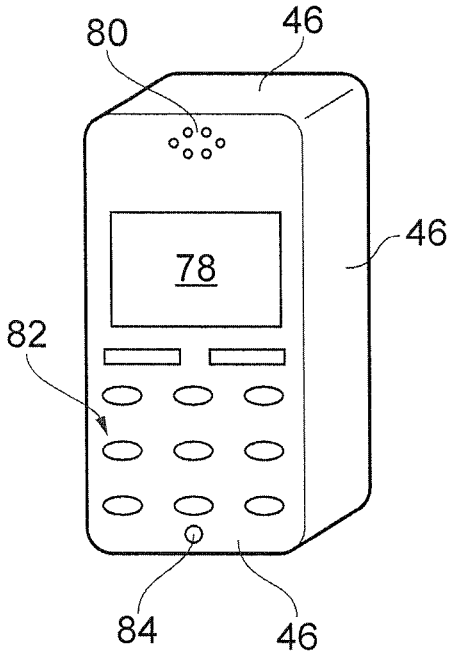
FIG. 4A illustrates a front view of a mobile cellular telephone according to various embodiments of the present invention.
Figure 4B:
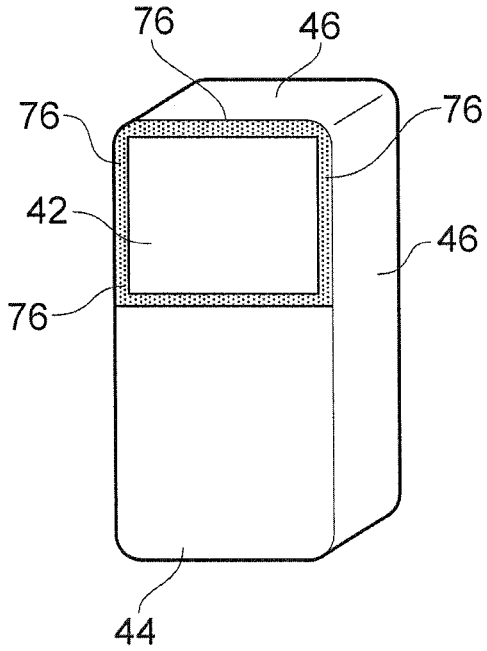
FIG. 4B illustrates a rear view of a mobile cellular telephone according to various embodiments of the present invention.

FIGS. 4A and 4B illustrate front and rear views respectively of one embodiment of a mobile cellular telephone 10. As can be viewed in FIG. 4A, the third cover portion 46 provides the exterior surface of the front and sides of the apparatus 10. The third cover portion 46 may include apertures for a display 78, a loudspeaker 80, a keypad 82 and a microphone 84. The third cover portion 46 may comprise metal and be conductive or it may be plastic and be non-conductive, or it may be a combination of both conductive and non-conductive materials.

As can be viewed in FIG. 4B, the first conductive cover portion 42 and the second conductive cover portion 44 provide the exterior surface of the rear of the mobile cellular telephone 10. It should be appreciated that the wording 'front', 'rear' and 'sides' are with respect to the position in which the user operates the mobile cellular telephone (e.g. the display 78 is provided on the 'front' of the mobile cellular telephone). The first and second conductive cover portions 42, 44 comprise metal and are electrically conductive.

It should be appreciated that the first conductive cover portion 42 may have any shape and dimensions. For example, the first conductive cover portion 42 may extend at least partially over the sides and front of the mobile cellular telephone 10.

Returning to FIG. 2, in this embodiment the first conductive cover portion 42 defines an exterior surface 74 and an interior surface 86 of the apparatus 10. It should be appreciated that in other embodiments of the present invention, the exterior surface 74 and/or the interior surface 86 may not be defined by the first conductive cover portion 42. For example, the first conductive cover portion 42 may be coated in plastic which may protect the cover 22 from atmospheric damage (e.g. rain) and user damage (e.g. being scratched).

In various embodiments, the first conductive member 40 is positioned between the antenna 18 and the interior surface 86 of the first conductive cover portion 42 so that it can electromagnetically couple with the first conductive cover portion 42. In other embodiments, the first conductive member 40 may be electrically connected to the first conductive cover portion 42 via a galvanic connection (indicated by dotted line with reference numeral 88) and may not be positioned between the antenna 18 and the interior surface 86 of the first conductive cover portion 42. In other embodiments, the first conductive member 40 is configured to contactlessly (i.e. electromagnetically) couple with the first conductive cover portion 42. In this embodiment, the first conductive member 40 and the first conductive cover portion 42 are not electrically connected to the ground plane 24.

The second conductive member 41 is positioned so that it is adjacent the antenna 18. In this embodiment, the second conductive member 41 is connected to point 90 on the ground plane 24. In other embodiments, the second conductive member 41 may not be electrically connected to any other components within the apparatus 10.

Figure 5:
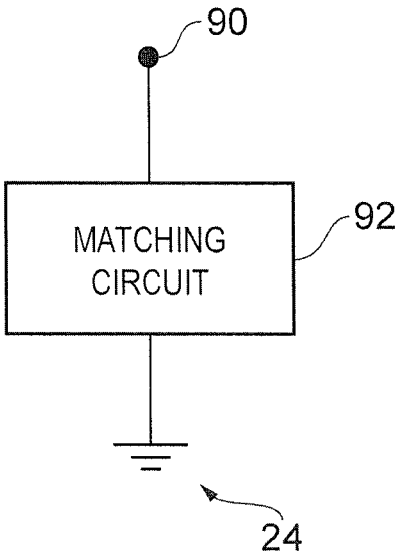
FIG. 5 illustrates a schematic diagram of matching circuitry according to various embodiments of the present invention.

As illustrated in FIG. 5, the second conductive member 41 may be connected to a matching circuit 92 and ground 24 via the point 90. The matching circuit 92 may include any combination of reactive components (e.g. transmission lines, capacitors and inductors) which provide the second conductive member 41 with a desired impedance and electrical length. Matching circuits are well known in the art of radio frequency (RF) circuit design and will consequently not be discussed in detail here.

It should be appreciated that the positioning, shape and dimensions of the first and second conductive members 40, 41 are selected to obtain a desired electrical length (and hence resonant frequency band) for the combination of the first conductive cover portion 42, the first conductive member 40 and the second conductive member 41. Additionally, or alternatively, the matching circuit 92 may be designed to obtain a desired electrical length (and hence resonant frequency band) for the combination of the first conductive cover portion 42, the first conductive member 40 and the second conductive member 41. In various embodiments, the first conductive member 40 may be shaped so that it snugly fits adjacent the interior surface 86 of the first conductive cover portion 42. Consequently, the first conductive member 40 may be curved in order to match the curvature of the first conductive cover portion 42. It should also be appreciated that as a consequence of this, that the antenna 18 and the second conductive member 41 may also follow the curvature of the first conductive member 40 and the first conductive cover portion 42. Such an arrangement may reduce the volume required for the first and second conductive members 40, 41 and may increase the electromagnetic coupling between the first conductive member 40, the second conductive member 41 and the first conductive cover portion 42.

The first conductive member 40, the second conductive member 41 and the first conductive cover portion 42 are configured to couple together closely so that they appear as a single element to a radio frequency signal. The combination of the first conductive member 40, the second conductive member 41 and the first conductive cover portion 42 is thereby configured to operate in a second resonant frequency band, different to the first and third resonant frequency bands. It should be appreciated that the second resonant frequency band is determined by the combined electrical lengths of the first conductive cover portion 42, the first conductive member 40 and the second conductive member 41.

In operation, the combination of the first conductive member 40, the second conductive member 41 and the first conductive cover portion 42 is configured to be contactlessly fed (i.e. electromagnetically) by the antenna 18. For example, if the antenna 18 is the same as that illustrated in FIG. 3, the combination is configured to be contactlessly fed by an RF signal from the antenna 18 in either the first resonant frequency band or the third resonant frequency band.

The combined electrical lengths of the first conductive member 40, the second conductive member 41 and the first conductive cover portion 42 are selected to enable electromagnetic coupling between the combination 40, 41, 42 and the antenna 18. The electrical length of the combination of the first conductive member 40, the second conductive member 41 and the first conductive cover portion 42 may be adjusted by changing the dimensions of the first conductive member 40 and/or the second conductive member 41 and/or the first conductive cover portion 42. The electrical length of the combination 40, 41 and 42 may also be adjusted by changing the impedance of the matching circuit 92. However, since the first and second conductive members 40, 41 are not visible to the user (as they are obscured by the cover 22), it may be preferable to only alter the dimensions of the first conductive member 40 and/or the dimensions of the second conductive member 41 and/or the impedance of the matching circuit 92.

The electrical length of the combination of the first conductive member 40, the second conductive member 41 and the first conductive cover portion 42 can also be adjusted by changing the distance between them. For example, if the distance between the first conductive member 40 and the first conductive cover portion 42 is reduced, the combination 40, 41, 42 electromagnetically couple more strongly and the electrical length of the combination is increased. In various embodiments, the first conductive member 40, the second conductive member 41 and the first conductive cover portion 42 may be positioned as close to one another as possible.

It should be appreciated that the first conductive member 40 may at least partially overlap the aperture 76 to enable coupling to the second conductive cover portion 44. This may allow further adjustment of the second resonant frequency band, as formed from the combination of the first conductive cover portion 56, the first conductive member 40 and the second conductive member 41.

It should also be appreciated that although the resonant frequency bands of the combination 40, 41, 42 and the antenna 18 are different to one another, the resonant frequency band of the combination 40, 41, 42 should at least partially overlap with the resonant frequency band of the antenna 18 in order to produce a resonance in the combination of the first and conductive members 40, 41 and the first conductive cover portion 42. For example, in the embodiment where the antenna 18 is similar to that illustrated in FIG. 3, the first resonant frequency band may be PCN/DCS1800 (1710-1880 MHz), the second resonant frequency band may be US-WCDMA1900 (1850-1990) and the third resonant frequency band may be US-GSM 850 (824-894 MHz). In this example, RF signals in the first resonant frequency band of the antenna element 18 contactlessly feed the combination of the first and second conductive members 40, 41 and the first conductive cover portion 42 and cause them to resonate at the second resonant frequency band (since they partially overlap).

In the embodiment where the antenna 18 is a PIFA and has an electrical length L1, the antenna 18 resonates at L1=λ/4. The combination of the first and second conductive members 40, 41 and the first conductive cover portion 42 have an electrical length L2 and resonate at L2=λ/2. Assuming that the resonant frequency band of the combination 40, 41, 42 is similar to the resonant frequency band of the antenna 18, for the combination 40, 41, 42 to be contactlessly fed by the antenna element 18, the combination 40, 41, 42 should have an electrical length L2 that is approximately twice the electrical length L1 of the antenna 18.

The antenna 18 and the combination 40, 41, 42 may be arranged to operate in a plurality of different operational radio frequency bands and via a plurality of different protocols. For example, the different frequency bands and protocols may include (but are not limited to) AM radio (0.535-1.705 MHz); FM radio (76-108 MHz); Bluetooth (2400-2483.5 MHz); WLAN (2400-2483.5 MHz); HLAN (5150-5850 MHz); GPS (1570.42-1580.42 MHz); US-GSM 850 (824-894 MHz); EGSM 900 (880-960 MHz); EU-WCDMA 900 (880-960 MHz); PCN/DCS 1800 (1710-1880 MHz); US-WCDMA 1900 (1850-1990 MHz); WCDMA 2100 (Tx: 1920-1980 MHz Rx: 2110-2180 MHz); PCS1900 (1850-1990 MHz); UWB Lower (3100-4900 MHz); UWB Upper (6000-10600 MHz); DVB-H (470-702 MHz); DVB-H US (1670-1675 MHz); DRM (0.15-30 MHz); Wi Max (2300-2400 MHz, 2305-2360 MHz, 2496-2690 MHz, 3300-3400 MHz, 3400-3800 MHz, 5250-5875 MHz); DAB (174.928-239.2 MHz, 1452.96-1490.62 MHz); RFID LF (0.125-0.134 MHz); RFID HF (13.56-13.56 MHz); RFID UHF (433 MHz, 865-956 MHz, 2450 MHz). An operational frequency band is a frequency range over which an antenna can efficiently operate. Efficient operation occurs, for example, when the antenna's insertion loss S11 is greater than an operational threshold such as 4 dB or 6 dB Embodiments of the present invention provide an advantage in that by providing the first and second conductive members 40, 41 to couple with the first conductive cover portion 42, the operational resonant frequency band of the first conductive cover portion 42 may no longer be substantially determined by the dimensions of the first conductive cover portion 42. This may provide greater design freedom for the first conductive cover portion 42 because changes in its dimensions and hence resonant frequency can be compensated by the first and second conductive members 40, 41 which are not visible to the user.

Usually, the first conductive cover portion 42 is not designed by an antenna engineer but by an industrial or graphic designer for the apparatus 10. Embodiments of the present invention provide an advantage because it provides freedom of design for the industrial designer and allows him/her to design an almost fully metallised apparatus. It also provides an advantage for the antenna designer because it allows him/her to tune the first conductive cover portion 42 to the required frequency bands without having to alter the shape or dimensions of the first conductive cover portion 42.

In various embodiments of the invention, a buffer member 94 may be provided between the first conductive cover portion 42 and the first conductive member 40 to absorb impacts to the exterior of the apparatus 10 and prevent them from damaging the first and second conductive members 40, 41, support 38 and antenna 18 stack. The buffer member 94 may comprise any suitable resilient material and may comprise, for example, rubber.

The second conductive cover portion 44 may be a portion of the cover 22 and define an exterior surface of the apparatus 10 (as illustrated in FIG. 2). In other embodiments, the second conductive cover portion 44 may be a cover for an electronic component within the apparatus (for example, it may be a metallic cover for the battery of the apparatus 10). The second conductive cover portion 44 comprises metal, is electrically conductive and may or may not be connected to the ground plane 24.

The second conductive cover portion 44 is configured to electromagnetically couple with the combination of the first conductive cover portion 42, the first conductive member 40 and the second conductive member 41 and thereby change the electrical length (and hence resonant frequency band) of the combination of the first conductive cover portion 42, the first conductive member 40 and the second conductive member 41. For example, if the distance between the combination of the first conductive cover portion 42, the first conductive member 40, the second conductive member 41, and the second conductive cover portion 44 is decreased, the electromagnetic coupling strengthens between them and increases the electrical length of the combination and thereby reduces the resonant frequency of the combination. In order to not alter the appearance of the exterior of the apparatus 10, the first conductive member 40 and/or the second conductive member 41 may be moved closer to, or away from the second conductive cover portion 44 in order to strengthen or weaken the electromagnetic coupling as desired.

Embodiments of the present invention provide an advantage in that the second conductive cover portion 44 may be used to further lower the resonant frequency of the combination of the first conductive member 40, the second conductive member 41 and the first conductive cover portion 42. This may be particularly advantageous when there is insufficient space in the apparatus 10 to provide the combination of the first and second conductive members 40, 41 and the first conductive cover portion 42 with a desired electrical length.

In various embodiments of the present invention, the second conductive member 41 may be configured to have an electrical length selectable from a plurality of electrical lengths.

Figure 6:
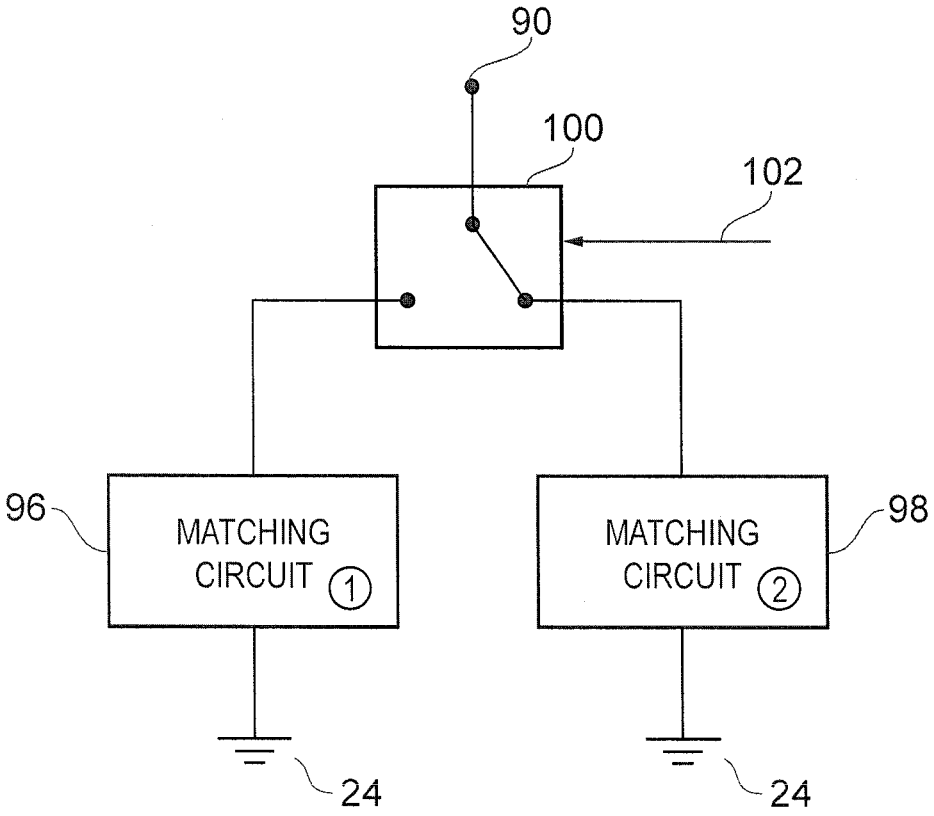
FIG. 6 illustrates a schematic diagram of matching circuitry according to various embodiments of the present invention.

As illustrated in FIG. 6, the second conductive member 41 may be connected, at point 90, to a first matching circuit 96 and a second matching circuit 98 via a switch 100. The first and second matching circuits 96, 98 are connected to ground 24 and include reactive components such as capacitors and inductors. In this embodiment, the controller 12 is configured to provide a control signal 102 to the switch 100 to connect the second conductive member 41 to the first matching circuit 96 or to the second matching circuit 98. The first matching circuit 96 is different to the second matching circuit 98 and consequently, they each provide the second conductive member 41 with a different electrical length.

Embodiments of the present invention may provide an advantage in that by controlling the electrical length of the second conductive member 41 by connecting the second conductive member 41 to either the first matching circuit 96 or to the second matching circuit 98, the controller 12 is able to change the electrical length and hence operational frequency band of the combination of the first and second conductive members 40, 41 and the first conductive cover portion 42. It should be appreciated that in other embodiments, there may be more than two matching circuits connected to the switch 100.

Figure 7:
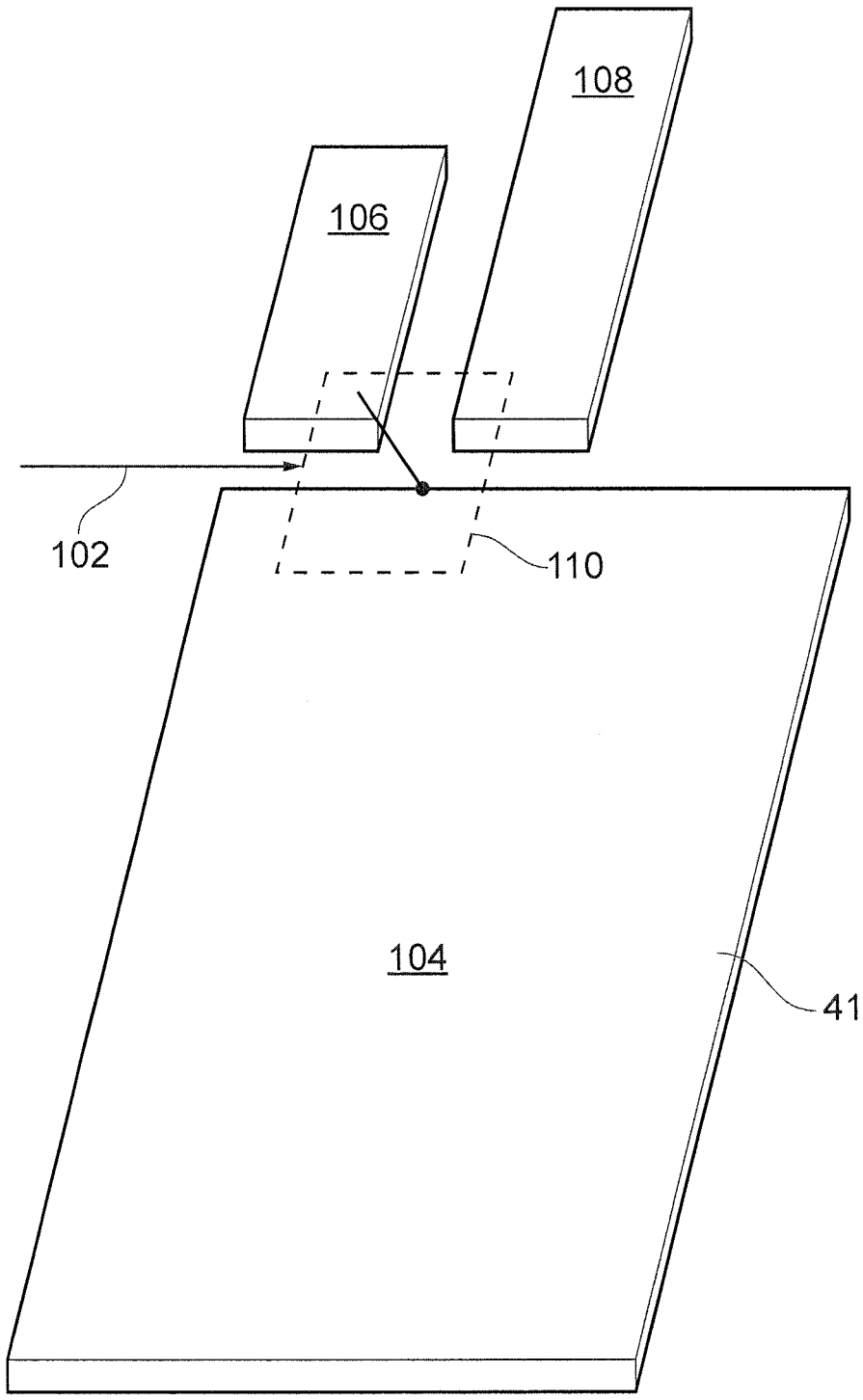
FIG. 7 illustrates a perspective view of a conductive member according to various embodiments of the present invention.

As illustrated in FIG. 7, the second conductive member 41 may comprise a plurality of substantially planar metallic plates and may include a first portion 104, a second portion 106 and a third portion 108. A switch 110 is mounted on the first portion 104 and is configured to receive a control signal 102 from the controller 12. The controller 12 is configured to control the switch 102 so that the first portion 104 is connected to either the second portion 106 or to the third portion 108. The second portion 106 has a different electrical length to the third portion 108 and consequently, each of the second and third portions 106, 108 may provide the second conductive member 41 with a different electrical length.

Embodiments of the present invention may provide an advantage in that by controlling the electrical length of the second conductive member 41 by connecting the first portion 104 to either the second portion 106 or the third portion 108, the controller 12 is able to change the electrical length and hence operational frequency band of the combination of the first and second conductive members 40, 41 and the first conductive cover portion 42. It should be appreciated that the second conductive member 41 may include more than two selectable portions. Additionally, it should be appreciated that the second and third portions 106, 108 may comprise reactive components such as capacitors and inductors.

It should be appreciated that in various embodiments, the apparatus 10 may include a module 111 which comprises any combination of: the antenna 18, the feed point 34, the ground point 36, the support member 38, the first conductive member 40, the second conductive member 41, the point 90 and the buffer 94. The module 111 may be manufactured separately from the cover 22 and the other components of the apparatus 10. The apparatus 10 may be assembled at a different location and time to the location and time of the manufacture of the module 111.

In some embodiments of the present invention, the module 111 may comprise any combination of: the antenna 18, the feed point 34, the ground point 36, the support member 38, the first conductive member 40, the second conductive member 41, the point 90, the buffer 94, the first cover portion 42, the second cover portion 44 and the third cover portion 46. In these embodiments, the cover portions 42, 44, 46 may define one or more exterior surfaces of the module 111.

Figure 8:
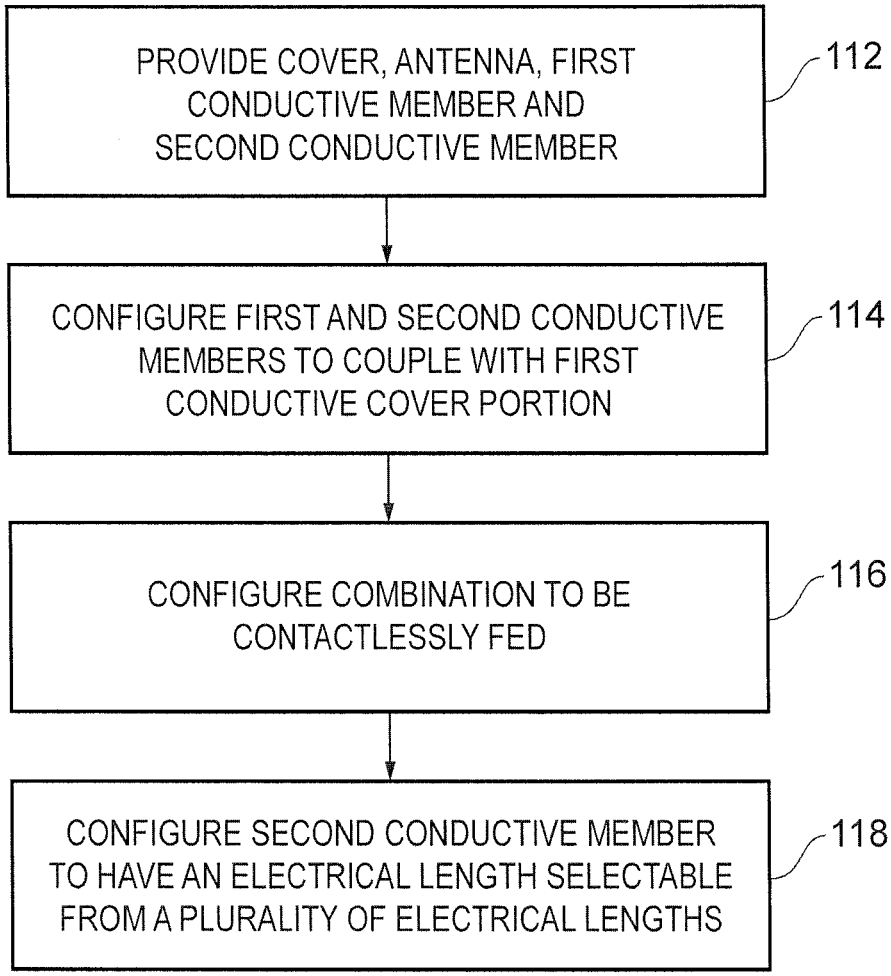
FIG. 8 illustrates a flow diagram which shows the main blocks for manufacturing an apparatus according to various embodiments of the present invention.

FIG. 8 illustrates a flow chart which shows some of the blocks for manufacturing an apparatus 10 as illustrated in FIGS. 1 and 2. The illustration of a particular order to the blocks does not necessarily imply that there is a required or preferred order for the blocks and the order and arrangement of the blocks may be varied.

At block 112, the method includes providing the cover 22, the antenna 18, the first conductive member 40 and the second conductive member 41. At block 114, the method includes configuring the first and second conductive members 40, 41 so that they couple with the first conductive cover portion 42. At block 116, the method includes configuring the combination of the first conductive cover portion 42 and the first and second conductive members 40, 41 to be contactlessly fed by the antenna 18. At block 118, the method includes configuring the second conductive member 41 so that it may have an electrical length selectable from a plurality of electrical lengths. The second conductive member 41 may be configured to be connected to a plurality of matching circuits as illustrated in FIG. 6 or so that it includes a plurality of selectable portions as illustrated in FIG. 7.

It should be appreciated that in embodiments where the apparatus 10 includes a module 111, block 114 includes providing the antenna 18, the first conductive member 40 and the second conductive member 41 to form the module 111 and also providing the cover 22 and the module 111.

Figure 9:
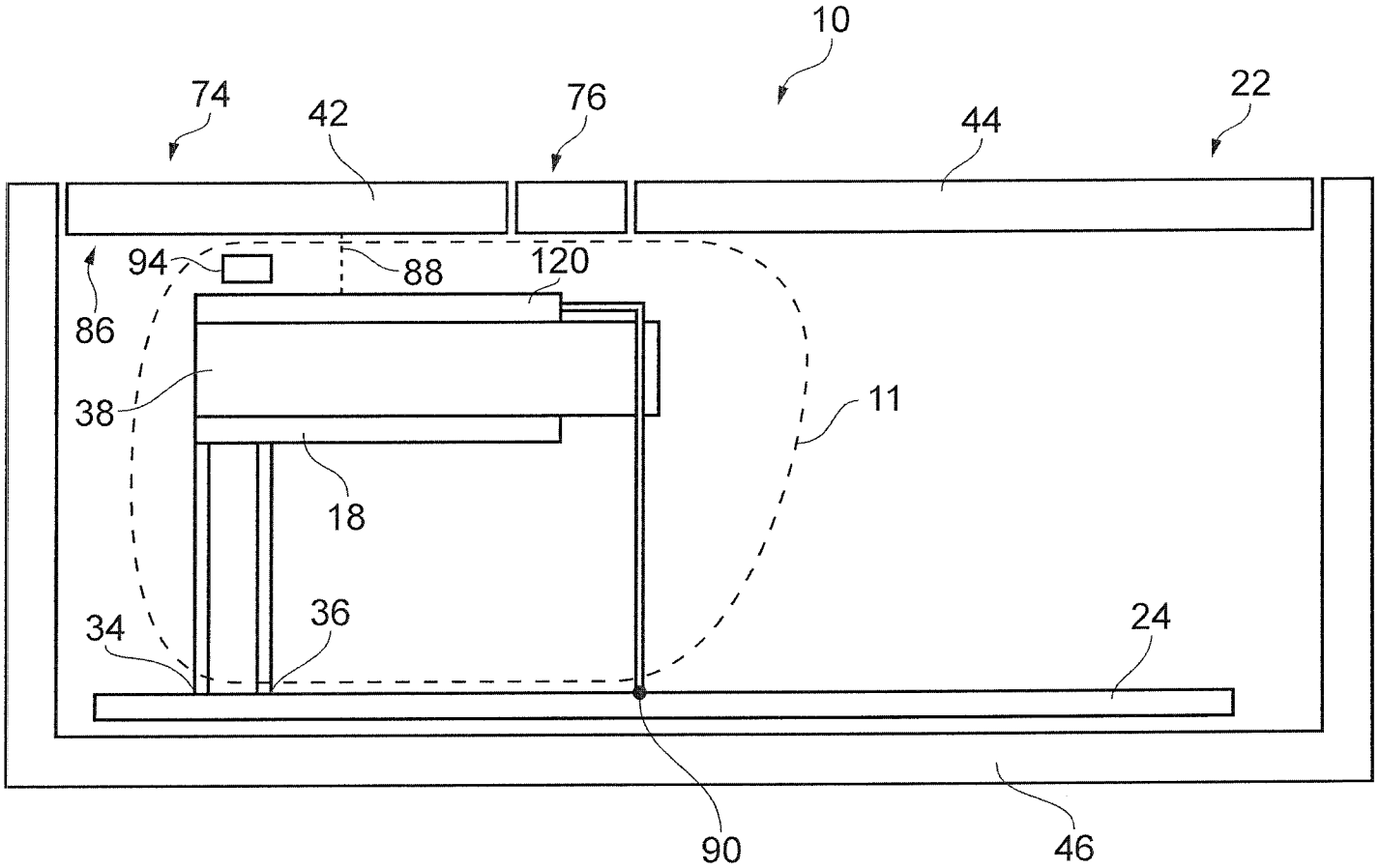
FIG. 9 illustrates a schematic cross sectional side view of an apparatus according to various embodiments of the present invention.

FIG. 9 illustrates a cross sectional side view of an apparatus according to various embodiments of the present invention. The apparatus 10 illustrated in FIG. 9 is similar to the apparatus illustrated in FIGS. 1 and 2 and where the features are similar, the same reference numerals are used.

The apparatus 10 illustrated in FIG. 9 differs from the apparatus illustrated in FIGS. 1 and 2 in that it does not include a first conductive member 40 or a second conductive member 41. However, the apparatus 10 illustrated in FIG. 9 does include a conductive member 120 which may be positioned between the interior surface 86 of the first conductive cover portion 42 and the antenna 18 and is configured to couple with the first conductive cover portion 42. The combination of the conductive member 120 and the first conductive cover portion 42 are configured to be contactlessly fed by the antenna 18.

The conductive member 120 is configured to have an electrical length selectable from a plurality of electrical lengths. The conductive member 120 may be connected to a plurality of matching circuits and a switch (as illustrated in FIG. 6) via point 90. Additionally or alternatively, the conductive member 120 may include a plurality of selectable portions as illustrated in FIG. 7. The combination of the conductive member 120 and the first conductive cover portion 42 are operable in a plurality of operational resonant frequency bands, different to the first resonant frequency band of the antenna 18.

The apparatus 10 illustrated in FIG. 9 provides an advantage in that the conductive member 120 may be controlled by a controller 12 of the apparatus 10 to tune the combination of the conductive member 120 and the first conductive cover portion 42 to a desired operational frequency band.

It should be appreciated that the second conductive member 41 may be designed and positioned such that the apparatus 10 illustrated in FIG. 2 electromagnetically appears to be the same as the apparatus 10 illustrated in FIG. 9. In particular, this may be achieved if the second conductive member 41 is made relatively large and is placed in close proximity to the first conductive member 40. In this embodiment, the first and second conductive members 40, 41 electromagnetically appear to be a single conductive member, similar to the conductive member 120 illustrated in FIG. 9.

It should be appreciated that in various embodiments, the apparatus 10 may include a module 111 which comprises any combination of: the antenna 18, the feed point 34, the ground point 36, the support member 38, the conductive member 120, the point 90 and the buffer 94. The module 111 may be manufactured separately from the cover 22 and the other components of the apparatus 10. The apparatus 10 may be assembled at a different location and time to the location and time of the manufacture of the module 111.

In some embodiments of the present invention, the module 111 may comprise any combination of: the antenna 18, the feed point 34, the ground point 36, the support member 38, the conductive member 120, the point 90, the buffer 94, the first cover portion 42, the second cover portion 44 and the third cover portion 46. In these embodiments, the cover portions 42, 44, 46 may define one or more exterior surfaces of the module 111.

Figure 10:
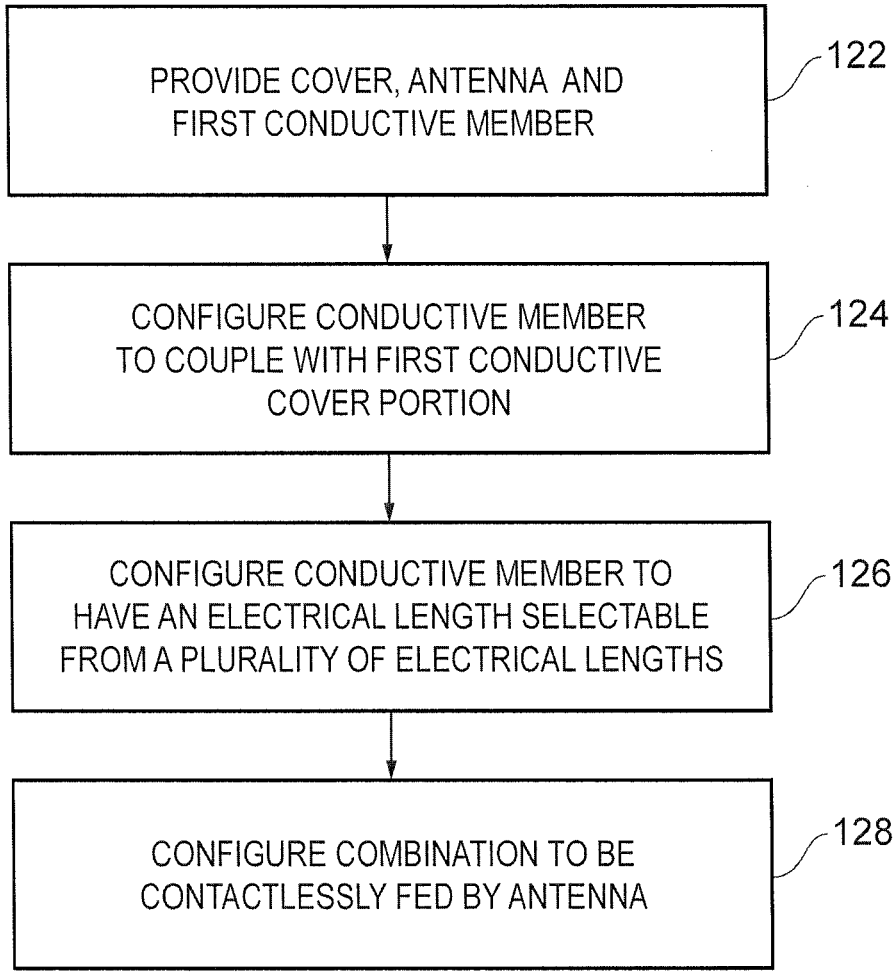
FIG. 10 illustrates a flow diagram which shows the main blocks for manufacturing an apparatus according to various embodiments of the present invention.

FIG. 10 illustrates a flow chart which shows some of the blocks for manufacturing an apparatus 10 as illustrated in FIG. 9. The illustration of a particular order to the blocks does not necessarily imply that there is a required or preferred order for the blocks and the order and arrangement of the blocks may be varied.

At block 122, the method includes providing the cover 22, the antenna 18 and the conductive member 120. At block 124, the method includes configuring the conductive member 120 so that it couples with the first conductive cover portion 42. At block 126, the method includes configuring the conductive member 120 so that it may have an electrical length selectable from a plurality of electrical lengths. The conductive member 120 may be configured to be connected to a plurality of matching circuits as illustrated in FIG. 6 or so that it includes a plurality of selectable portions as illustrated in FIG. 7. At block 128, the method includes configuring the combination of the first conductive cover portion 42 and the conductive member 120 to be contactlessly fed by the antenna 18.

It should be appreciated that in embodiments where the apparatus 10 includes a module 111, block 122 includes providing the antenna 18 and the conductive member 120 to form the module 111 and also providing the cover 22 and the module 111.

Figure 11:
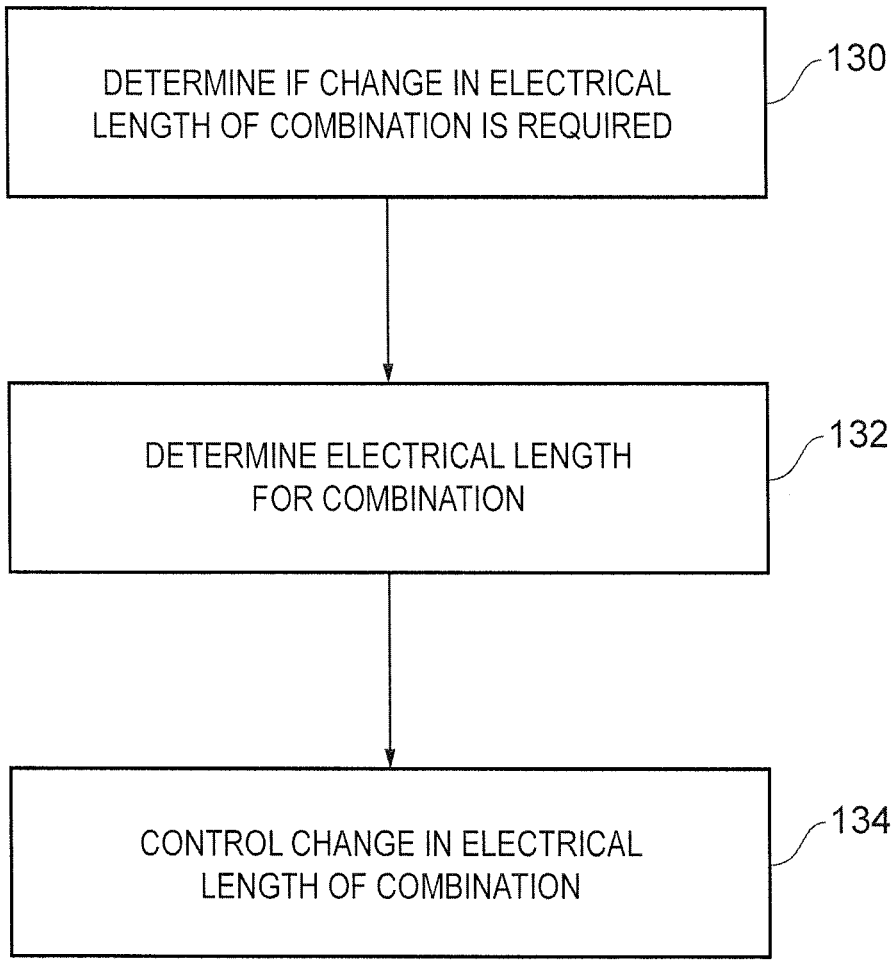
FIG. 11 illustrates a flow diagram of a computer program according to various embodiments of the present invention.

FIG. 11 illustrates a flow diagram of a computer program 30 according to various embodiments of the present invention. When the computer program 30 is loaded into the controller of the apparatus 10 illustrated in FIGS. 1, 2 and 9, it causes the controller to perform the blocks mentioned in the following paragraph.

At block 130, the method includes determining if a change in the electrical length of the combination 40, 41, 42 or 120, 42 is required. For example, the controller 12 may determine, in response to a user input, that the user wishes to use the apparatus 10 to communicate in a particular operational frequency band. At block 132, the controller 12 determines the desired electrical length for the combination 40, 41, 42 or 120, 42. For example, the controller 12 may determine the electrical length needed for the particular operational frequency band by checking a lookup table stored in the memory 14. At block 134, the method includes controlling the change in the electrical length of the combination 40, 41, 42 or 120, 42. For example, the controller 12 may control the electrical length of the combination 40, 41, 42 or 120, 42 by sending a control signal 102 to the switch 100 illustrated in FIG. 6 or to the switch 110 illustrated in FIG. 7.

The computer program instructions may provide: computer readable program means 30 for selecting an electrical length for the second conductive member 41 or the conductive member 120 from a plurality of electrical lengths. The computer program instructions may provide: computer readable program means 30 for controlling a switch to connect the second conductive member 41 or the conductive member 120 to one of a plurality of matching networks, the plurality of matching networks providing at least some of the plurality of electrical lengths. The computer program instructions may provide: computer readable program means 30 for controlling a switch to select one of a plurality of selectable portions of the second conductive member 41 or the conductive member 120, the plurality of selectable portions providing at least some of the plurality of electrical lengths.

The blocks illustrated in the FIG. 11 may represent steps in a method and/or sections of code in the computer program 30. The illustration of a particular order to the blocks does not necessarily imply that there is a required or preferred order for the blocks and the order and arrangement of the block may be varied. Furthermore, it may be possible for some steps to be omitted.

Although embodiments of the present invention have been described in the preceding paragraphs with reference to various examples, it should be appreciated that modifications to the examples given can be made without departing from the scope of the invention as claimed. For example, a matching circuit (such as the one illustrated in FIG. 5 or FIG. 6) may be provided in the ground arm which extends between the second conductive member 41 and the point 90. Additionally, the apparatus 10 may include more than one antenna and the antenna 18 may include one or more patches which may each have their own feed arrangement.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a cover defining an exterior surface of the apparatus and including a first conductive cover portion;

an antenna, connected to a feed point and configured to operate in at least a first resonant frequency band;

a conductive member configured to couple with the first conductive cover portion and configured to have an electrical length selectable from a plurality of electrical lengths; and wherein the combination of the conductive member and the first conductive cover portion are operable in a plurality of resonant frequency bands, different to the first resonant frequency band and are configured to be contactlessly fed by the antenna.

2. An apparatus as claimed in claim 1, wherein the first conductive cover portion defines an interior surface and/or an exterior surface of the cover.

3. An apparatus as claimed in claim 1, wherein the conductive member is positioned between the interior surface of the first conductive cover portion and the antenna.

4. An apparatus as claimed in claim 1, wherein the conductive member is connected to a plurality of matching circuits via a switch.

5. An apparatus as claimed in claim 1, wherein the conductive member includes a plurality of selectable portions.

6. An apparatus as claimed in claim 1, further comprising a support member defining an upper surface and a lower surface, the antenna being physically coupled to the lower surface of the support member and the conductive member being physically coupled to the upper surface of the support member.

7. A portable device comprising an apparatus as claimed in claim 1.

8. A non-transitory computer-readable storage medium encoded with instructions that, when executed by a controller of an apparatus as claimed in claim 1, perform: selecting an electrical length for the conductive member from the plurality of electrical lengths.

9. A method comprising: providing: a cover defining an exterior surface of an apparatus and including a first conductive cover portion; an antenna, connected to a feed point and configured to operate in at least a first resonant frequency band; a conductive member; configuring the conductive member to couple with the first conductive cover portion and configuring the conductive member to have an electrical length selectable from a plurality of electrical lengths; and wherein the combination of the conductive member and the first conductive cover portion being operable in a plurality of resonant frequency bands, different to the first resonant frequency band and are configured to be contactlessly fed by the antenna.

10. A method as claimed in claim 9, wherein the first conductive cover portion defines an interior surface and/or an exterior surface of the cover.

11. A method as claimed in claim 9, wherein the conductive member is positioned between the interior surface of the first conductive cover portion and the antenna.

12. A method as claimed in claim 9, wherein the conductive member is connected to a plurality of matching circuits via a switch.

13. A method as claimed in claim 9, wherein the conductive member includes a plurality of selectable portions.

14. A method as claimed in claim 9, further comprising providing a support member defining an upper surface and a lower surface, the antenna being physically coupled to the lower surface of the support member and the conductive member being physically coupled to the upper surface of the support member.

15. A module comprising:

an antenna, connected to a feed point and configured to operate in at least a first resonant frequency band;

a conductive member configured to couple with a first conductive cover portion of a cover defining an exterior surface of an apparatus and configured to have an electrical length selectable from a plurality of electrical lengths; and wherein the combination of the conductive member and the first conductive cover portion are operable in a plurality of resonant frequency bands, different to the first resonant frequency band and are configurable to be contactlessly fed by the antenna.

16. A module as claimed in claim 15, wherein the conductive member is connected to a plurality of matching circuits via a switch.

17. A module as claimed in claim 15, wherein the conductive member includes a plurality of selectable portions.

18. A module as claimed in claim 15, further comprising a support member defining an upper surface and a lower surface, the antenna being physically coupled to the lower surface of the support member and the conductive member being physically coupled to the upper surface of the support member.

* * * * *